United States Patent [19]

Kübler

[11] Patent Number: 4,582,042

[45] Date of Patent: Apr. 15, 1986

[54] CEILING RADIATION HEATER AND METHODS OF OPERATING SAME

[76] Inventor: Gerd Kübler, 106-116 Neckarauer Strasse, D-6800 Mannheim 1, Fed. Rep. of Germany

[21] Appl. No.: 357,523

[22] Filed: Mar. 12, 1982

[30] Foreign Application Priority Data

Mar. 13, 1981 [AT] Austria ..... 1158/81

[51] Int. Cl.[4] ..... F24C 3/00

[52] U.S. Cl. ..... 126/91 A; 237/70; 165/909

[58] Field of Search ..... 126/92 AC, 92 B, 92 R, 126/131, 91 A; 237/55, 54, 70; 165/DIG. 12; 432/175

[56] References Cited

U.S. PATENT DOCUMENTS

| | | | |
|---|---|---|---|
| 385,571 | 7/1888 | Pickup | 237/54 |
| 2,594,914 | 4/1952 | Grosskloss | 126/92 B |
| 2,946,510 | 7/1960 | Galvin | 237/70 |
| 3,805,763 | 4/1974 | Cowan | 126/92 B |
| 3,920,383 | 11/1975 | Kerr | 432/175 |
| 4,008,707 | 2/1977 | Bartlett | 126/131 |

FOREIGN PATENT DOCUMENTS

| | | | |
|---|---|---|---|
| 187663 | 11/1956 | Austria . | |
| 2458223 | 12/1974 | Fed. Rep. of Germany | 237/54 |
| 606020 | 10/1925 | France | 126/91 A |
| 813101 | 5/1959 | United Kingdom | 126/91 R |

*Primary Examiner*—Henry Bennett

*Attorney, Agent, or Firm*—Seidel, Gonda, Goldhammer & Abbott

[57] ABSTRACT

A ceiling radiation heater has a plurality of hot-air radiation pipes arranged as high as possible below the ceiling at a distance from the ceiling and from each other in one or several planes longitudinally parallel side by side and combined in groups, with reflectors behind which thermally insulating layers may be provided arranged above and laterally of the pipes. Combustion gases and/or waste heat available from production processes may be introduced into the air-filled, closed hot-air radiation pipe system.

2 Claims, 6 Drawing Figures

CEILING RADIATION HEATER AND METHODS OF OPERATING SAME

The invention relates to a ceiling radiation heater having a plurality of hot-air radiation pipes arranged as high as possible below the ceiling at a distance from the ceiling and from each other in one or several planes longitudinally parallel side by side and combined in groups, with reflectors behind which thermally insulating layers may be provided arranged above and laterally of them, and methods of operating the ceiling radiation heater.

It is the object of the invention to reduce the energy requirement and the heating-up period of such heaters.

These objects are achieved according to the invention by introducing combustion gases and/or waste heat available from production processes into the air-filled, closed hot-air radiation pipe system and optionally providing indirect heating for the radiation pipe system.

The direct contact of the combustion gases or the waste heat from production processes with the air in the hot-air radiation pipes causes a particularly energysaving and extremely fast heating up of the air. Moreover, excellent heating is achieved in rooms with high ceilings, in particular of the floor of workshops and the like, which greatly increases the comfort of the occupants. Moreover, gas heating does not call for tall chimneys and can be operated with conventional ones.

According to a further embodiment of the invention, one or more outlets having metering means are provided in the system to assure an economical discharge of the combustion products in lots. Moreover, means for feeding combustion air and fuel may be provided, a separate blower or ventilator may be provided for the combustion air outside of the system and the combustion air may be preheated by the discharged combustion products or waste gases via heat exchangers. Two basic embodiments are possible: a ventilator for circulating the heating medium can be arranged upstream of the burner or heat exchanger or a ventilator for circulating the heating medium can be arranged downstream of the burner or heat exchanger. A particularly favorable embodiment of the invention provides for the introduction of combustion gases from special gas burners for liquid gas, natural gas or city gas into the closed system. But it is also possible to provide one-stage or multistage oil burners, in particular for the indirect additional heating of the system. Since the invention provides for the use of hot-air radiation pipes, hot air or a mixture of hot air and combustion gases and waste heat from production processes, of a comparatively high temperature, in particular of 80° to 400° C., optionally even up to 425° C., is preferred.

According to a further embodiment of the invention, a requirement-oriented control of the fuel, in particular the fuel gas, and of the combustion air may be provided, with adjustment of a slight excess of air at all times.

It is particularly advantageous to provide the visible underside of the pipe with a, particularly non-metallic, special radiation paint, preferably having a radiation factor of more than 3.5 $W/m^{2}$° C., said paint favorably having a temperature resistance of up to 425° C., preferably up to 600° C.

For the practical operation of the ceiling radiation heater according to the invention, it is particularly advantageous to flush the hot-air radiation pipe system with fresh air by means of an air circulating ventilator prior to introducing the combustion gases or igniting the burner until possibly infiltrated gas has escaped through a super-pressure pipe and to keep the ventilators for the combustion air and the circulating air running when switching off the heating plant until the entire hot-air radiation pipe system has been flushed with fresh air, so that the steam generated at combustion is completely expelled.

The invention is explained in detail by means of embodiments under reference to the drawings.

Figure 4:
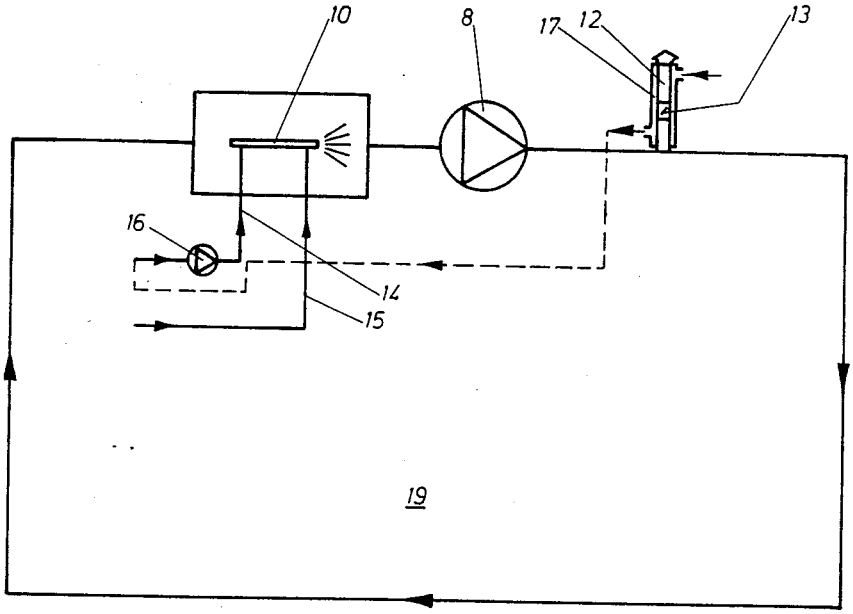
Figure 5:
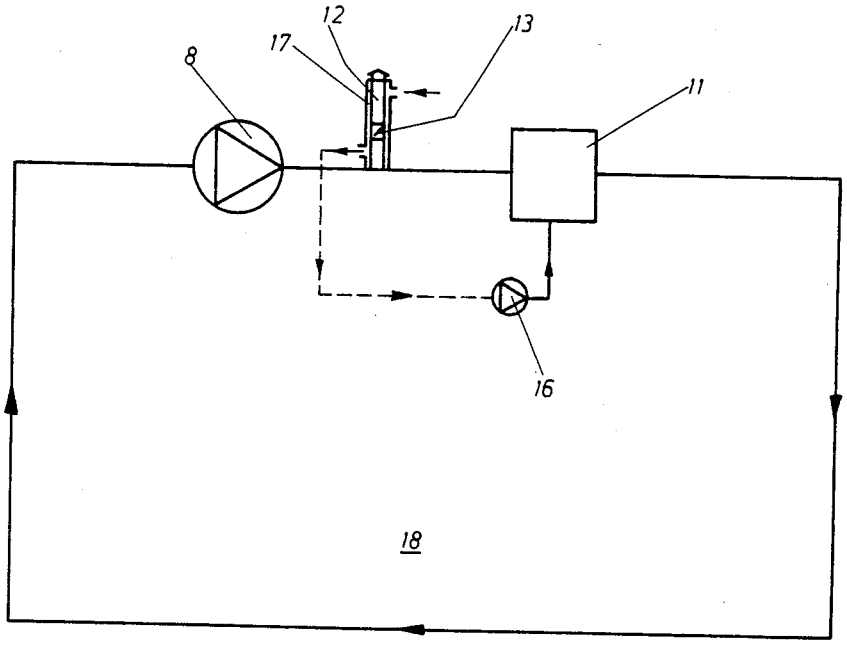

FIG. 4 as a further variant of the invention a plant diagram with modulating high-pressure gas heating in the sub-pressure range of the plant and FIG. 5 a plant diagram with energy from production processes as a third embodiment.

Figure 1:
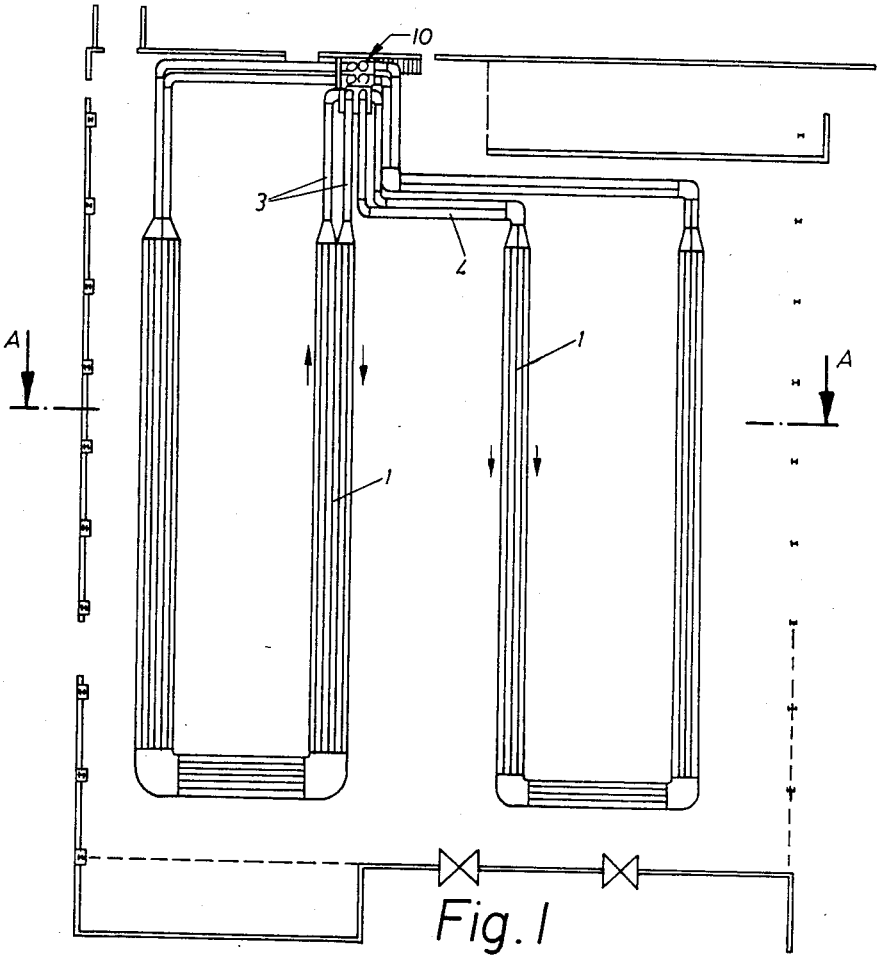
FIG. 1 shows a plan view of a workshop with diagrammatic representation of the ceiling radiation heater according to a first embodiment.
Figure 2:
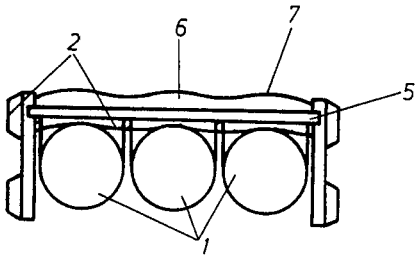
FIG. 2 shows a cross-sectional view in enlarged scale of a radiation heater pipe nest.

FIGS. 1 and 2 show a ceiling radiation heater according to the invention in which the suspension of the pipes 1 at the highest possible point of the hall is realized by means not represented. The individual pipes are laid in a closed system, with the reference number 3 showing the countercurrent principle and the reference number 4 showing the parallel-flow principle. A gas burner supplying both systems 3 and 4 with hot air is provided on the front face of the system. According to FIGS. 3 to 5, a blower or ventilator 8 and a super-pressure pipe 12 are arranged within this system. The blower or ventilator 8 circulates the fluid heated by the burner 10. The super-pressure pipe 12 serves the function of discharging the products formed on combustion into the atmosphere after they have cooled off. A heat exchanger 17 enclosing the super-pressure pipe heats the combustion air and thus considerably reduces natural losses. A further blower or ventilator 16 is provided for supplying the burner with combustion air. It is understood that suitable control valves and safety means are associated with the supply line.

As shown in FIG. 1, the pipelines each contain one row or one set of pipes arranged longitudinally side by side and parallel in relation to the floor level of the building. As shown in FIG. 2, each row of pipes is defined on each side by reflector plates 2 to prevent convection flow, and by a superposed thermally insulating layer 6 for thermal insulation, this insulating layer being provided with a reflector 2 on the side facing the radiation pipe and with a dust protection 7 on the side facing away from the radiation pipe. The insulating layer 6 and the lateral reflector plates 2 thus reduce any upward radiation and convection flow from the upper side of the pipes.

Figure 1A:
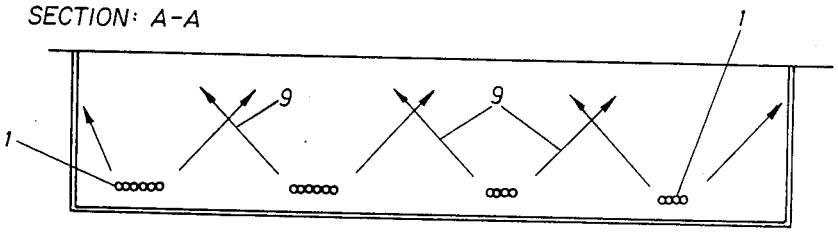
FIG. 1A shows a sectional view along plane A—A in FIG. 1.

The space between the pipelines is so selected, according to in FIG. 1A, that the heat radiation operlaps above the floor level at 9.

Figure 3:
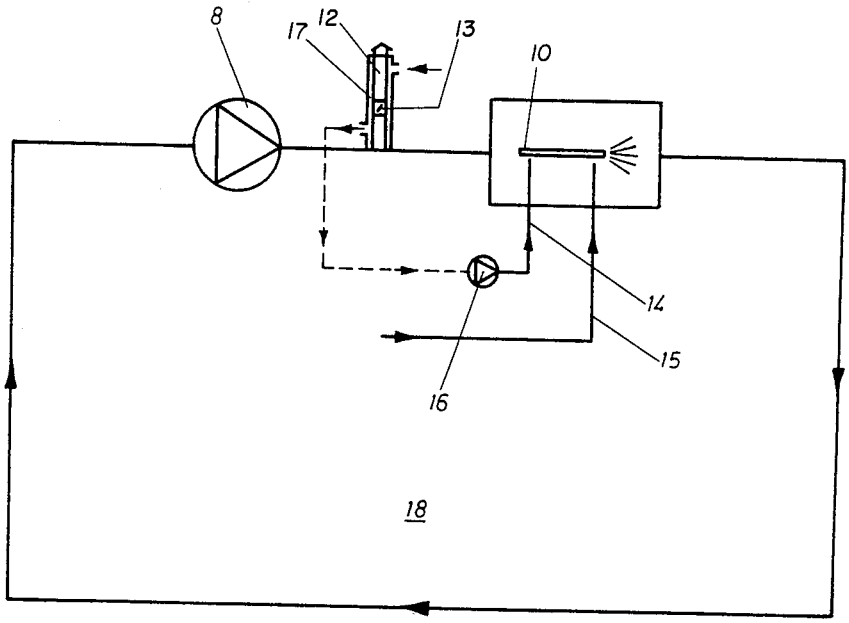
FIG. 3 shows a plant layout diagram with modulating high-pressure gas heating within the pressure range of the plant with super-pressure pipe.

FIGS. 3 to 5 show that the combustion air blower 16 and the air circulating blower 8 are operated before igniting the burner 10 until the entire system is flushed with fresh air so as to allow any gas which may have infiltrated the system due to a defect on the gas line to escape via the super-pressure pipe 12. The gas control organs are then slowly opened and the burner is ignited.

Parallel to this, the required combustion air is controlled corresponding to the gas volume. A mixture of air and combustion products is then introducted into the system. The mixture then quickly heats up to the selected operating temperature of the plant and this also increases the temperature of the pipes. Heat is thus transmitted to the inside of the building, mainly by radiation, but to a lesser degree also by convection, which is necessary for creating stabile room air conditions in the hall. When the heating plant switches off, first the burner comes to a standstill. The combustion air blower and the air circulating blower continue to operate until the system is flushed with fresh air, to assure that the steam generated at combustion is completely expelled.

In the aforementioned embodiment according to FIG. 1, the pipeline system contains 6 and 4 pipes arranged side by side. The system may comprise any given number of pipes, however. The invention further envisages alternative embodiments and arrangements of pipelines. So, for instance, the pipes may have a rectangular, triangular or oval shape in order to meet the respective radiation requirements.

I claim:

1. Ceiling radiation heater, in particular for halls, having a plurality of hot air radiation pipes arranged at a short distance from the ceiling in one or several planes longitudinally parallel and combined in groups, disposed either directly adjacent or at a distance necessitated by the pipe supports, with an upper reflector arranged above the pipes and lateral reflectors arranged laterally about the pipes with at least one thermally insulating layer arranged on the upper reflector, with the lateral reflectors arranged closely next to the pipes optionally projecting by a short distance below the pipes, wherein waste gases generated in at least one burner by the combustion of liquid gas, natural gas or city gas are introduced into the pipes which are air-filled, and from a closed pipe system, characterized in that the thermally insulating layer rests on the pipes, with sides of said thermally insulating layer carrying the lateral reflectors, that said thermally insulating layer being provided with a dust lining on a side of the thermally insulating layer facing away from the pipes, that combustion air supplied to the burner is preheated together with a heating medium conveyed in the pipes, said heating medium consisting of the waste gases and the system air, said heating medium having temperatures of about 80° to 400° C. after passing through the pipe system via heat exchangers and that optionally a waste heat available from production processes is additionally introduced into the pipes via hot air blowers.

2. The ceiling radiation heater according to claim 1 wherein the visible underside of the plurality of pipes is provided with a metal-free, radiation paint having a radiation factor of more than 3.5 $W/m^{2\circ}$ C., said paint having a temperature stability of up to 425° C.

* * * * *